US009653054B1

(12) United States Patent
Belli et al.

(10) Patent No.: US 9,653,054 B1
(45) Date of Patent: May 16, 2017

(54) SNARE ASSEMBLY FOR MUSICAL DRUM

(71) Applicant: REMO, INC., Valencia, CA (US)

(72) Inventors: Remo D. Belli, Valencia, CA (US); James H. May, Valencia, CA (US); Christopher J. Whittington, Valencia, CA (US)

(73) Assignee: REMO, INC., Valencia, CA (US)

( * ) Notice: Subject to any disclaimer, the term of this patent is extended or adjusted under 35 U.S.C. 154(b) by 22 days.

(21) Appl. No.: 14/937,777

(22) Filed: Nov. 10, 2015

(51) Int. Cl.
*G10D 13/02* (2006.01)

(52) U.S. Cl.
CPC ..... *G10D 13/025* (2013.01)

(58) Field of Classification Search
CPC .... G10D 13/02; G10D 13/021; G10D 13/025; G10D 13/027; G10D 13/00
USPC ..... 84/413, 415
See application file for complete search history.

(56) References Cited

U.S. PATENT DOCUMENTS

| | | | | |
|---|---|---|---|---|
| 1,291,903 | A * | 1/1919 | Isham | G10D 1/10 84/269 |
| 2005/0241457 | A1* | 11/2005 | Shimada | G10D 13/025 84/415 |
| 2009/0133564 | A1* | 5/2009 | Miyajima | G10D 13/025 84/415 |
| 2016/0042725 | A1* | 2/2016 | Huang | G10D 13/021 84/415 |

* cited by examiner

*Primary Examiner* — Kimberly Lockett
(74) *Attorney, Agent, or Firm* — Larry F. Gitlin; Beaumont Gitlin Tashjian

(57) ABSTRACT

A musical drum having a hollow shell with at least one opening defined by a circumferential bearing edge, a drumhead, which includes an upper surface consisting of the batter head and a bottom surface, a snare assembly with a plurality of individual wires having opposite end portions, a mounting member affixed to at least one end portion, and means for releasably attaching the snare assembly to the circumferential bearing edge comprising a flexible U-shaped clip in engagement with the circumferential bearing edge in pressure-contact relation. The individual snare wires are disposed in abutment against the bottom surface of the drumhead to cause the wires to vibrate upon the striking of the batter head.

17 Claims, 18 Drawing Sheets

SNARE ASSEMBLY FOR MUSICAL DRUM

BACKGROUND OF THE INVENTION

1. Field of the Invention

The present invention relates generally to the area of musical instruments. More particularly, the invention is directed to an improved retrofitted snare assembly for use in connection with musical drums.

2. Description of the Prior Art

Snare drums and, in particular, their snare component, which includes the trademark "buzz" sound, have existed in the prior art for many years. Various snare materials, such as brass, bronze, steel, gut or synthetics, may be used to create different "buzz" characteristics. The snare sound may emanate from the top head independently, such as used with a Cocktail drum, or in conjunction with the bottom head, such as used with a Scottish Pipe Drum.

In the early 1940's, Cocktail drums were made for use in dance bands where a single drum was used for both a bass and a snare sound. The bottom head was used to produce the bass tone while the top head employed the snare component to produce the snare sound. An internally mounted snare "fan" was created for this instrument so that the top head could produce the sound normally made with a two-headed drum. Additionally, to save costs from having to produce bulky and complex snare related hardware, most entry level snare drums were fitted with internally mounted snare wire units.

One of the very early types of frame drums that provided the snare sound was the Tambur, which used a single strand of gut or wire. Another type called a Tarol drum uses strands of wire that rest on the batter head side of the drumhead. A drum played with the hands (without drumsticks or mallets), such as an African djembe, would also incorporate external snares. These types of drums utilize externally mounted "add-on" snares.

Internal and external "add-on" snares or snare assemblies have been and continue to be produced by a variety of manufacturers. Each type is either mounted on the inside of the drumshell by means of metal fasteners, or on the outside of the drumshell by means of metal fasteners or clamping devices and the employment of cam levers.

"Add-on" or retrofitted snare units are installed either on the inside or the outside of the shell, where they are caused to make direct contact with the drumhead. Internal units are fixed to the drumshell sidewall and generally employ a threaded knob, which enables the player to make pressure adjustments to the wires against the drumhead. External snare units are typically fixed to some area of the counterhoop, the tension rod, or some other hardware component. Snare units can also be attached directly to the outside wall of the drumshell, where suitable connecting means are employed.

There are many options for securing and tensioning the snare wires as well as options for raising and lowering the snares relative to the drumhead. Individual adjustment screws for stretching each strand is more common with marching snare drums but are sometimes used with orchestral snare drums. By adjusting the tension in the wires, the player can contour the sound to fit the player's musical needs. Snare wires that are attached to opposite ends of the drumshell normally require twice the amount of hardware to hold, stretch, and adjust the unit, thereby almost certainly increasing the cost of the drum. Such drums are also quite heavy to carry or march with.

The present invention in its preferred and alternative embodiments includes significant improvements in the prior art heretofore not known or utilized. Accordingly, unlike prior art snare devices, the improved snare assembly of the present invention is easily installed on all types of drums, uncomplicated in construction and function, relatively lightweight and cost effective to manufacture.

SUMMARY OF THE INVENTION

In its preferred embodiment, the present invention constitutes a musical drum having a hollow shell with at least one opening defined by a circumferential bearing edge, a drumhead, which includes an upper surface consisting of the batter head and a bottom surface, a snare assembly with a plurality of individual wires having opposite end portions, a mounting member affixed to at least one end portion, and means for releasably attaching the snare assembly to the circumferential bearing edge. The individual snare wires are disposed in abutment against the bottom surface of the drumhead to cause the wires to vibrate upon the striking of the batter head. In the preferred embodiment of the present invention, the means for releasable attachment to the circumferential bearing edge constitutes a flexible U-shaped clip in engagement with the circumferential bearing edge in pressure-contact relation.

Accordingly, it is an object of the present invention to provide a musical drum with a snare assembly that can be easily installed on the circumferential bearing edge of a musical drumshell.

Another object of the present invention is to provide a musical drum with a snare assembly that is mounted on the circumferential bearing edge of a drumshell utilizing a flexible U-shaped clip in pressure-contact engagement with the bearing edge.

It is another object of the present invention to provide a musical drum with a snare assembly wherein the snare wires appropriately tensioned are directed to bear upon the underside of a drumhead to produce snare sounds when the batter head is struck.

Still another object of the present invention is to provide a musical drum with a snare assembly which incorporates a tray-like member with a channeled rim for mounting upon a circumferential bearing edge and supporting the snare wires to bear against the underside of a drumhead.

Another object of the present invention is to provide a musical drum with a snare assembly that is relatively lightweight.

Still another object of the present invention is to provide a musical drum with a snare assembly that is uncomplicated in its construction and function.

It is yet another object of the present invention to provide a musical drum with a snare assembly that is easy to install.

Yet another object of the present invention is to provide a musical drum with a snare assembly that is cost effective to manufacture.

Other objects and advantages of the present invention in all of its embodiments will become apparent in the following specifications when considered in light of the attached drawings wherein the preferred and alternative embodiments of the present invention are further illustrated.

BRIEF DESCRIPTION OF THE DRAWINGS

FIG. 1A is a perspective view of the preferred embodiment in accordance with the present invention in which the snare wires are configured spread apart fan-like.

DETAILED DESCRIPTION OF THE PREFERRED EMBODIMENT

Figure 1:
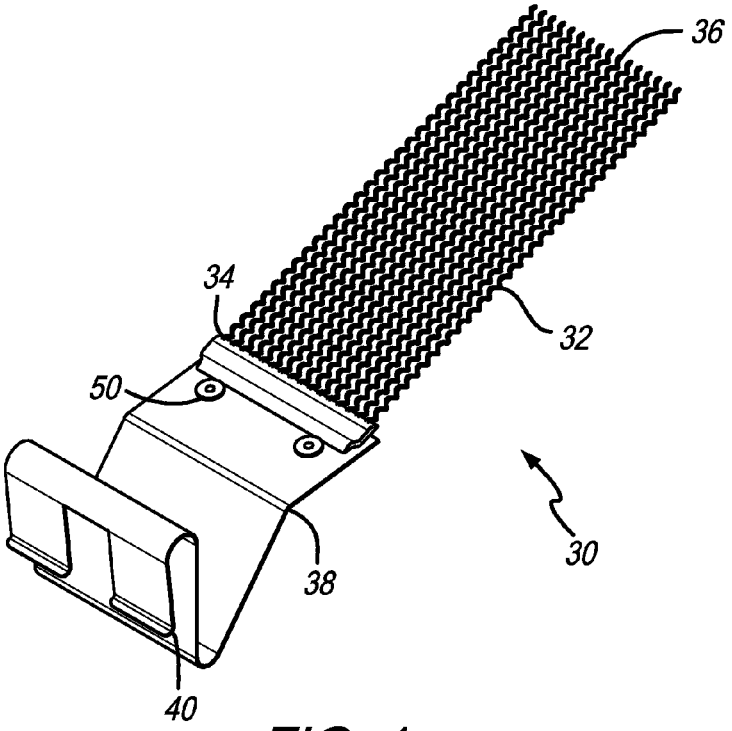
FIG. 1 is a perspective view of the preferred embodiment in accordance with the present invention.
Figure 1A:
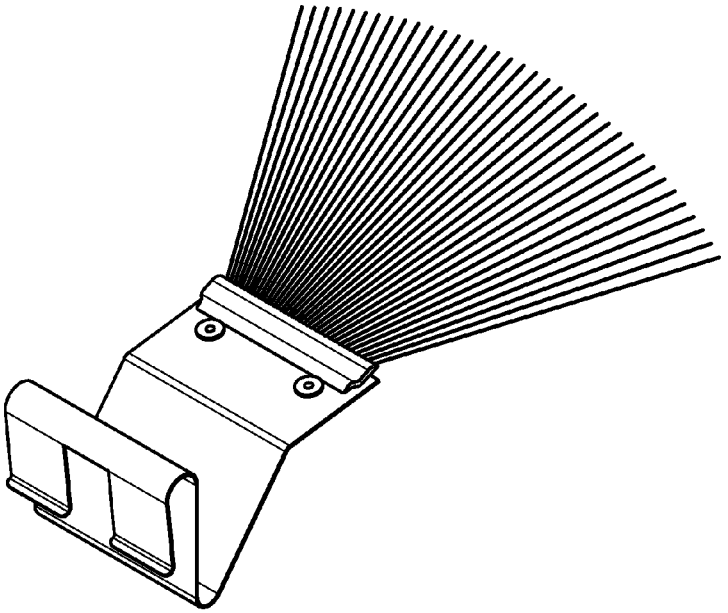
Figure 2:
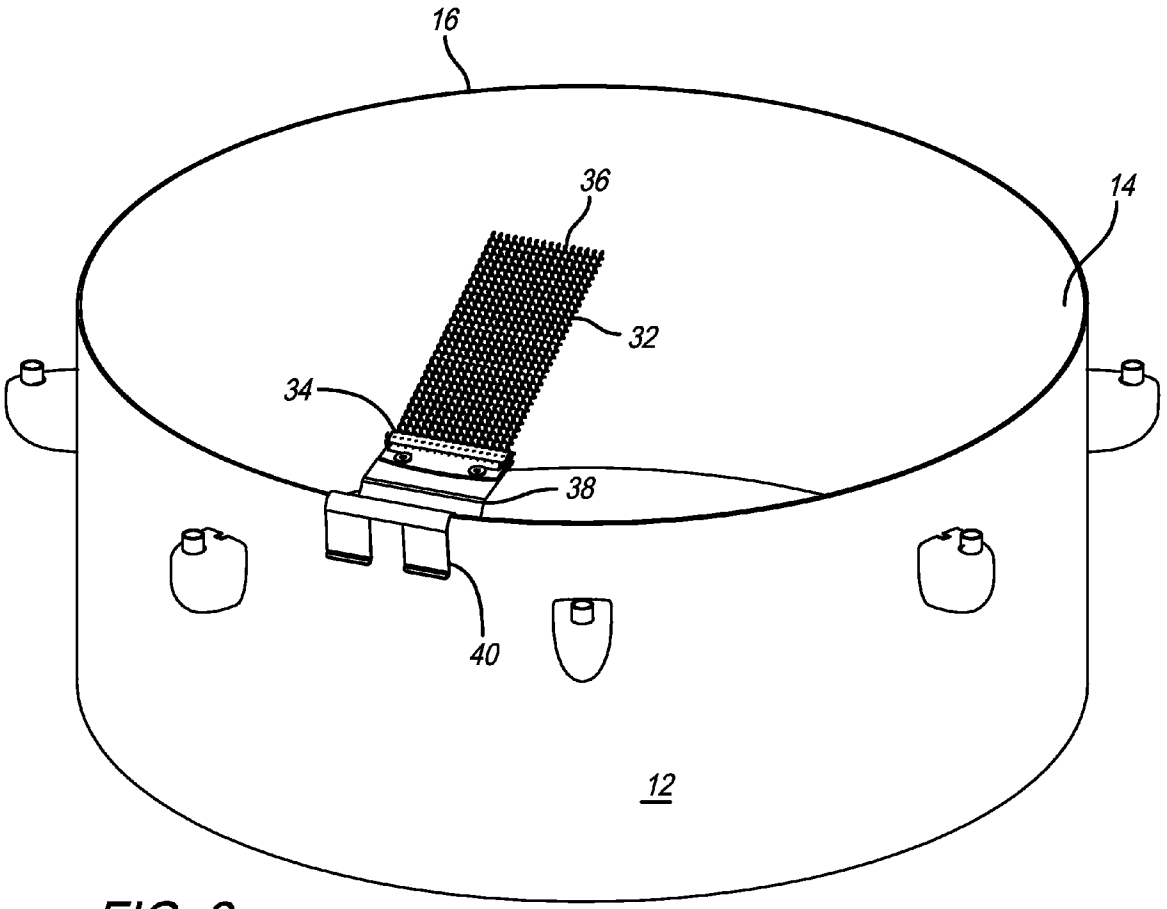
FIG. 2 is a perspective view of the snare assembly of FIG. 1 shown retrofitted to a musical drumshell.
Figure 3:
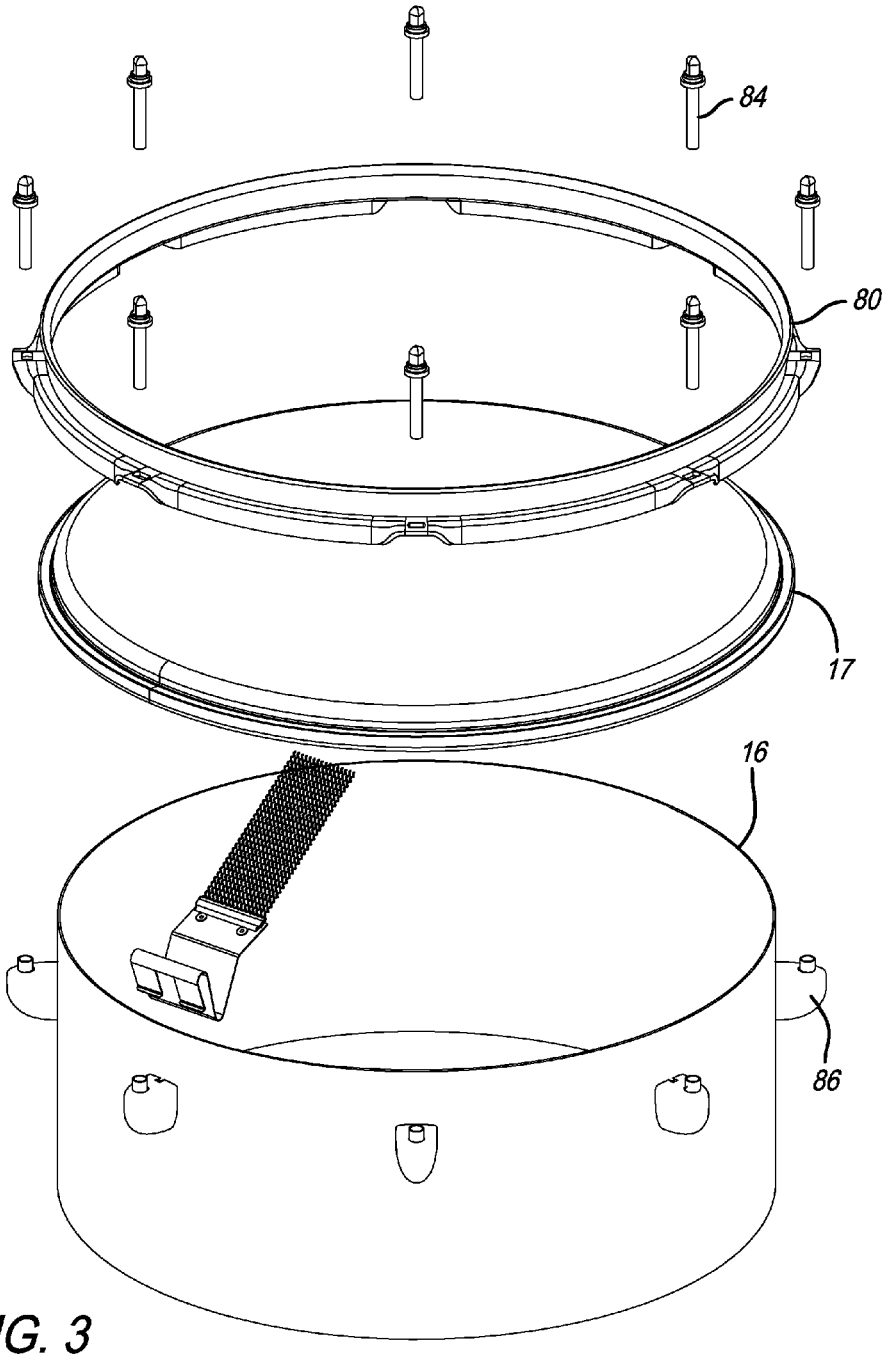
FIG. 3 is an exploded view of the snare assembly in accordance with the preferred embodiment of the present invention shown with various musical drum components and hardware.
Figure 4:
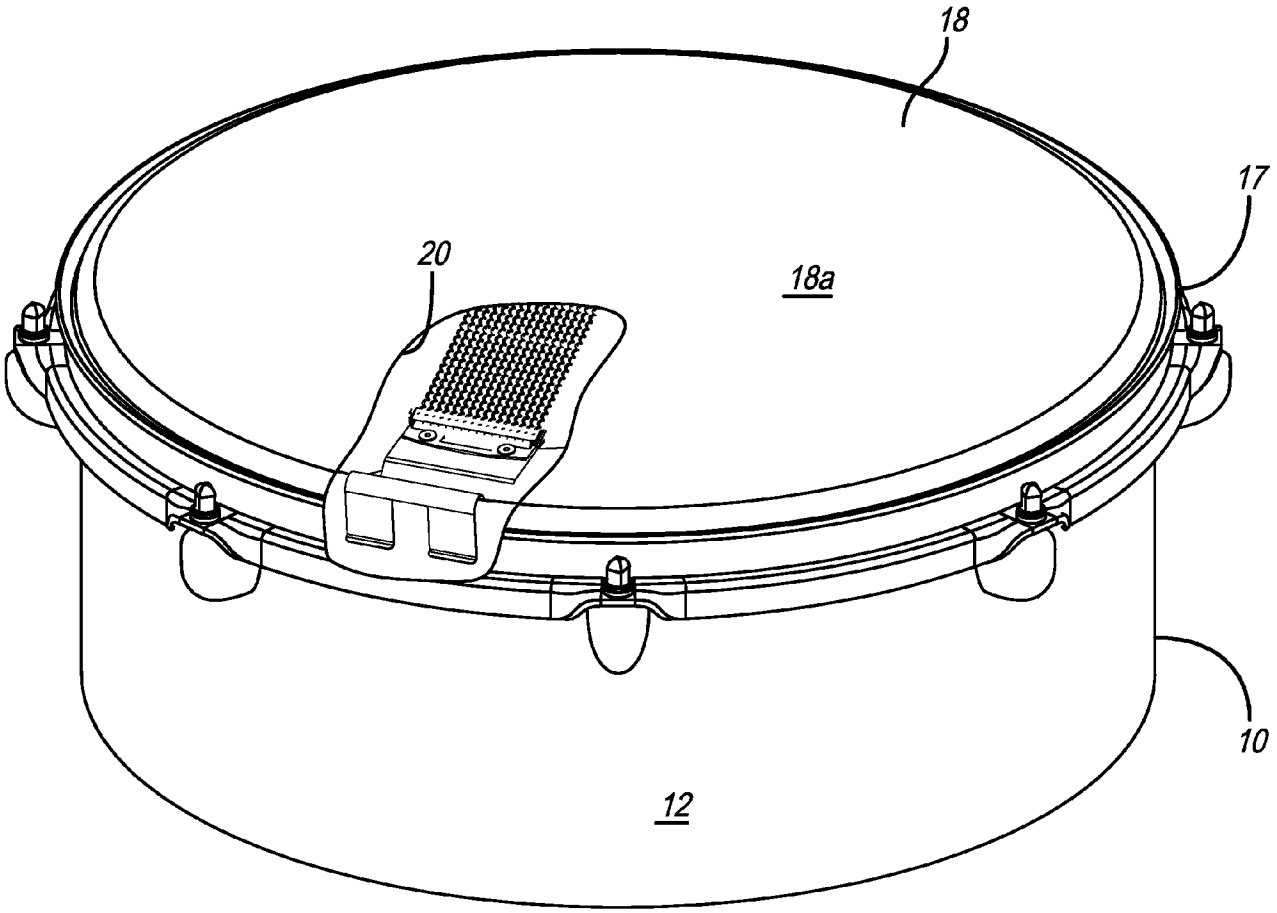
FIG. 4 is a break-away perspective view of the snare assembly in accordance with the preferred embodiment of the present invention shown retrofitted inside the shell of an assembled musical drum.
Figure 5:
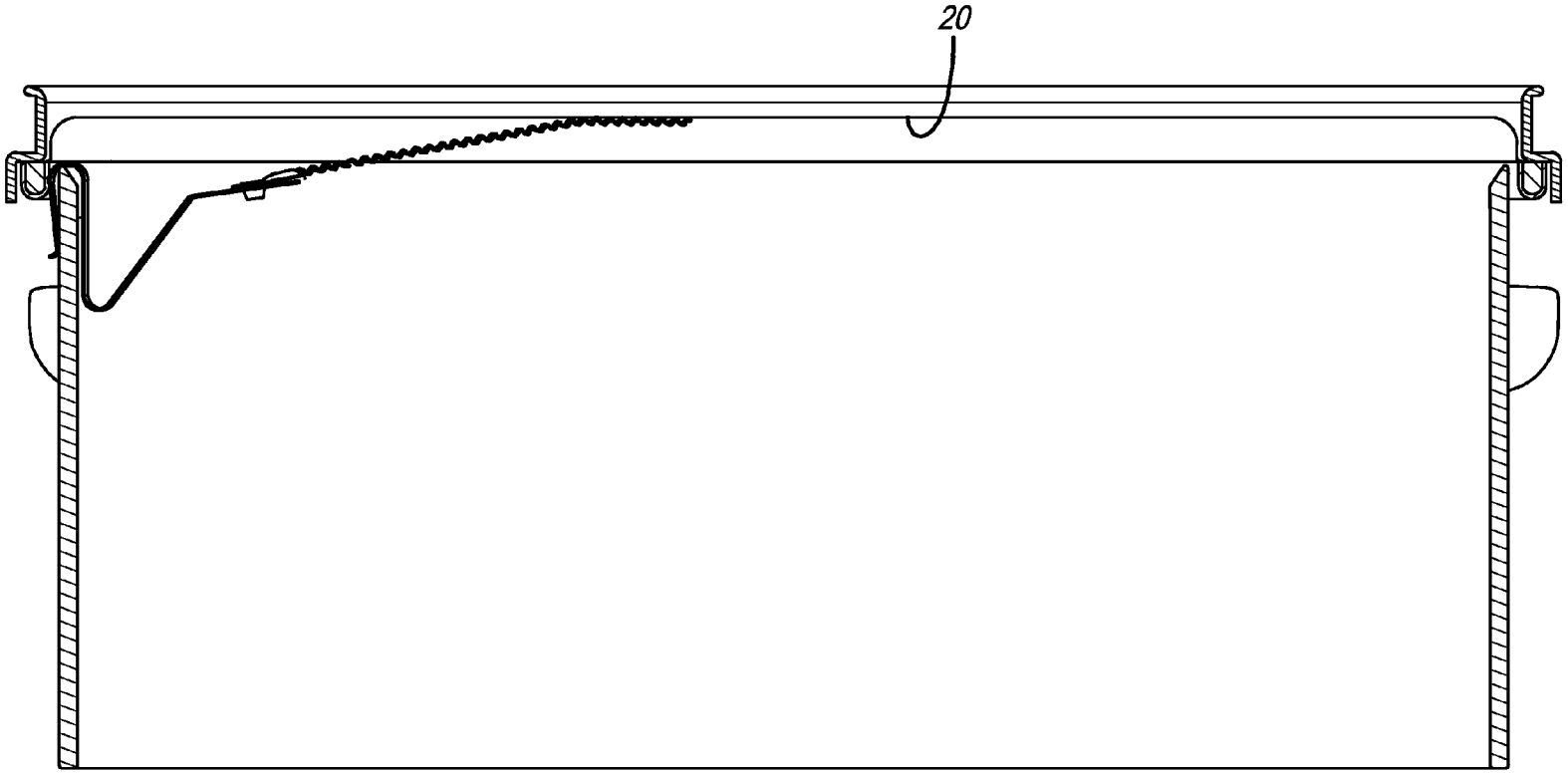
FIG. 5 is a cross-sectional view of the snare assembly in accordance with the present invention.
Figure 5A:
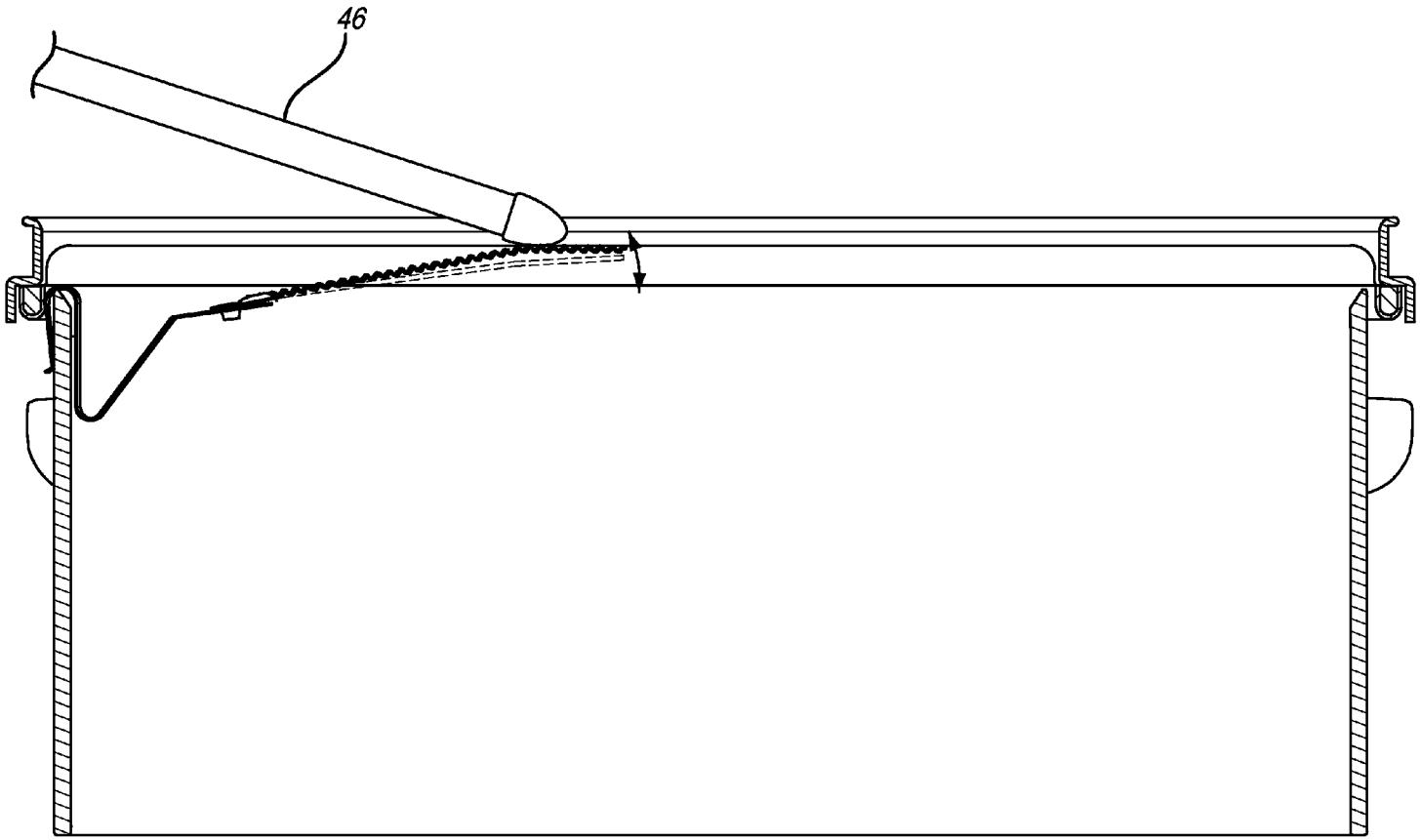
FIG. 5A is a cross-sectional view of the snare assembly in accordance with the preferred embodiment of the present invention shown with a drumstick striking the batter head and the snare wires vibrating accordingly.
Figure 6:
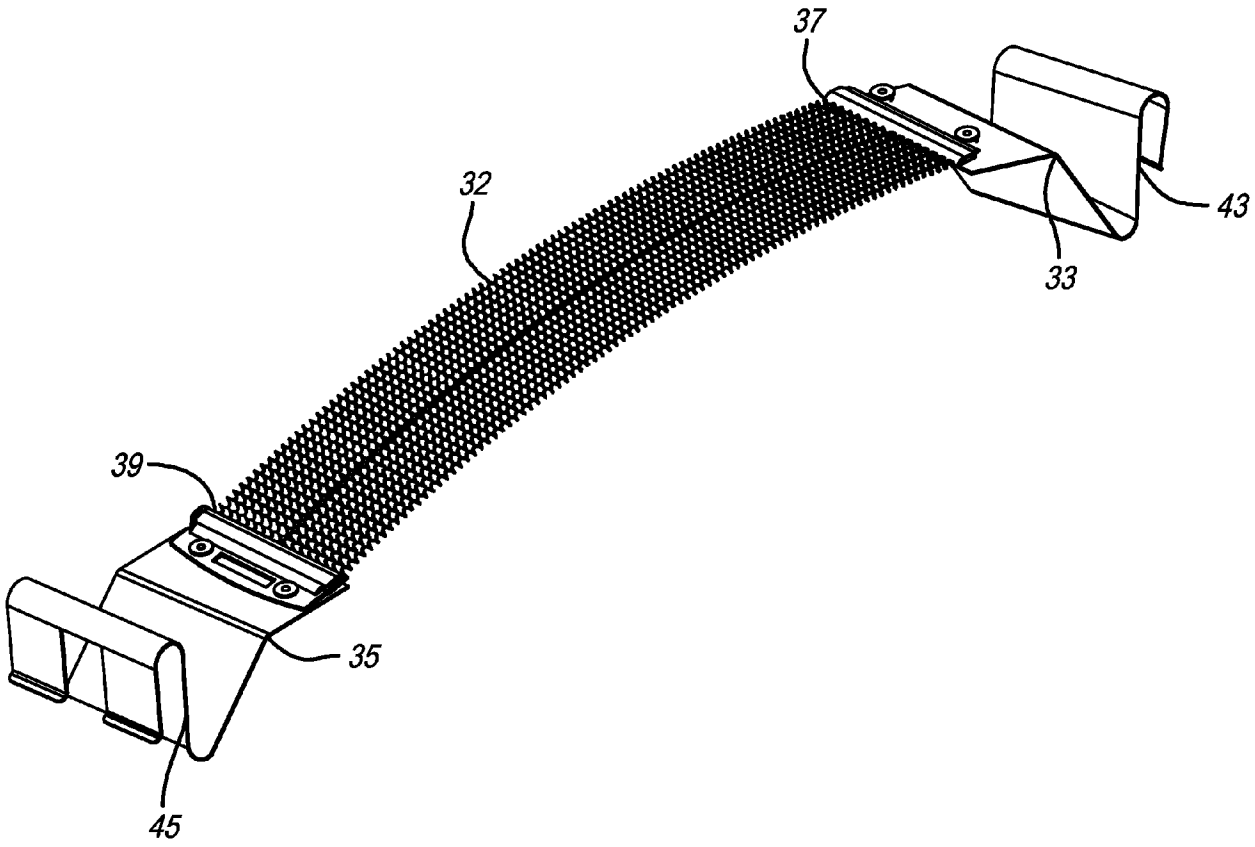
FIG. 6 is a perspective view of the snare assembly shown in accordance with an alternative embodiment of the present invention.
Figure 7:
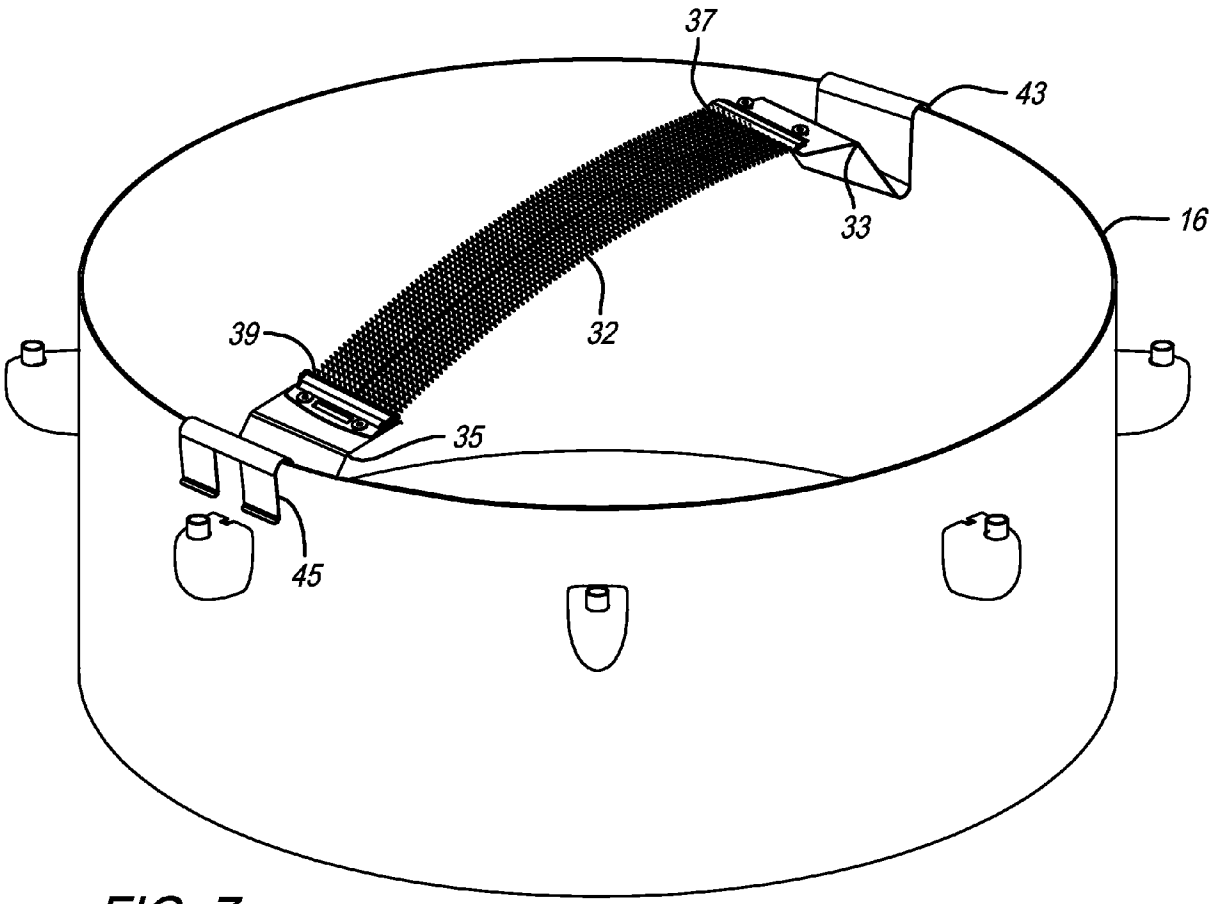
FIG. 7 is a perspective view of the snare assembly shown retrofitted on a drumshell in accordance with an alternative embodiment of the present invention.
Figure 8:
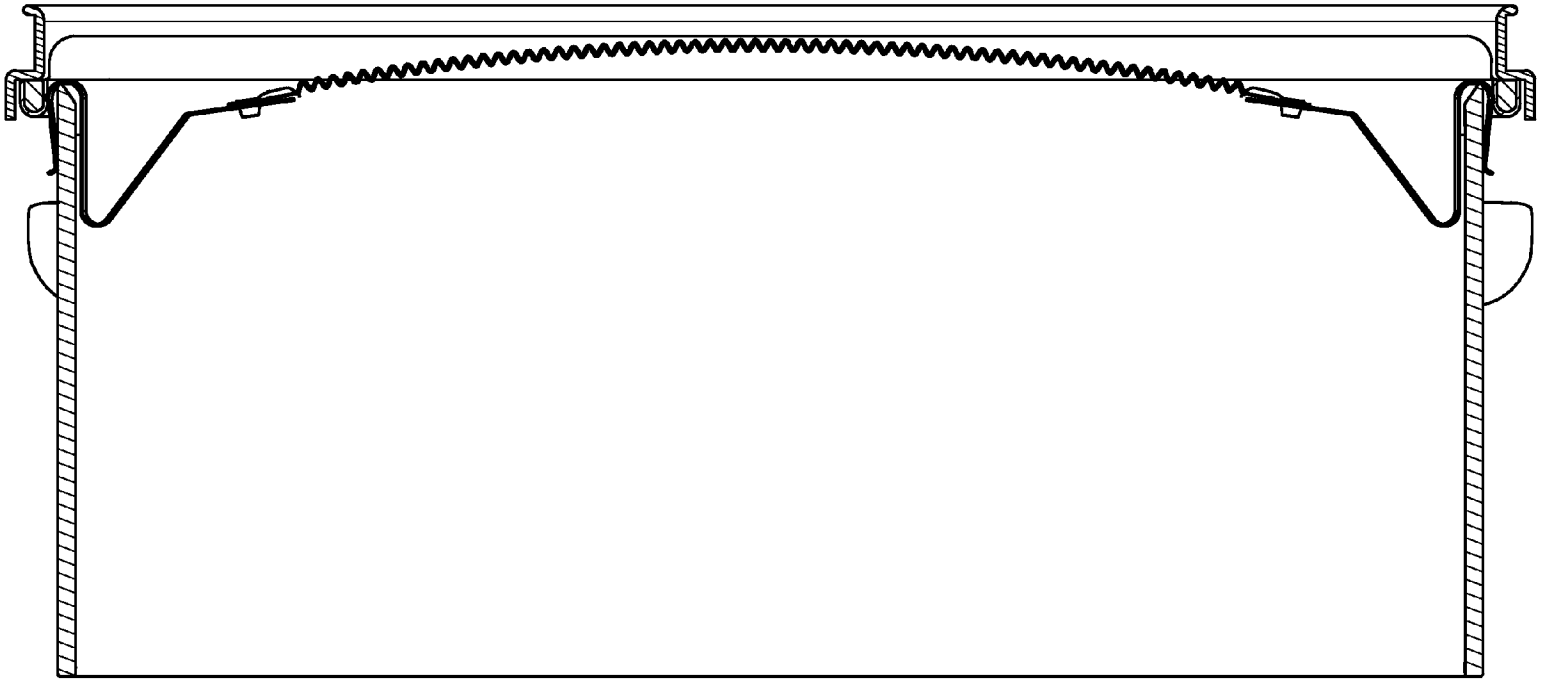
FIG. 8 is a cross-sectional view of the snare assembly in accordance with an alternative embodiment of the present invention.

The present invention provides a musical drum 10 comprising a hollow shell 12 having at least one opening 14 defined by circumferential bearing edge 16. Opening 14 is covered by drumhead 17 having upper surface 18 comprising batter head 18*a* and bottom surface 20. Also provided is snare assembly 30 having a plurality of individual snare wires 32 with opposing end portions 34 and 36. Fixed to end portion 34 is first mounting member 38, which includes flexible U-shaped clip 40 adapted to engage with circumferential bearing edge 16 in pressure-contact relation. U-shaped clip 40, which may be comprised of any suitable flexible material, such as a synthetic polymer or metal alloy, galvanized or otherwise, enables mounting member 38 the resiliency to releasably attach to circumferential bearing edge 16. Mounting member 38 is also adapted to direct individual snare wires 32 at an angle appropriate to abut bottom surface 20 of drumhead 17. This, in turn, causes individual snare wires 32 to vibrate upon the striking of batter head 18*a* by the player's hands or some hard object, such as drum stick 46. Snare wires 32 may be alternatively configured, such as, for example, shown in FIG. 1 or spread apart fan-like, as shown in FIG. 1A.

Mounting member 38 is typically resiliently bent at an outwardly facing reflex angle to best achieve its objective of properly directing snare wires 32 against bottom surface 20 of drumhead 17 to enable the production of the characteristic snare sounds. Snare wires 32, which may be comprised of any suitable metal alloy or synthetic material, are attached to mounting member 38 by any appropriate means, including the use of rivets 50, or screws or welds (not shown).

An alternative embodiment of the present invention comprises mounting member 33 and mounting member 35 with each member being fixed to corresponding opposing end portions 37 and 39 of snare wires 32. Flexible U-shaped clip 43 integrally formed with mounting member 33 is adapted for engagement with circumferential bearing edge 16 in pressure-contact relation. Flexible U-shaped clip 45 integrally formed with mounting member 35 is similarly adapted to engage with circumferential bearing edge 16 in pressure-contact relation.

Another alternative embodiment of the present invention comprises mounting member 38 and mounting member 41, with each being fixed to corresponding opposing end portions 60 and 62 of snare wires 32. End portion 60 includes a generally curved or bent end retention portion 61 and end portion 62 includes a generally curved or bent end retention portion 63. Also provided is tray-like member 64, which includes channeled rim portion 65 adapted for seating engagement upon circumferential bearing edge 16 and annular support member 66 integrally formed with channeled rim portion 65. Annular support member 66 includes opposing surfaces 68 and 69 in which slotted openings 70 and 72 are formed to receive corresponding curved or bent retention end portions 61 and 63 in mating relationship. Tray-like member 64 may be comprised of any suitable material, including, without limitation, synthetic polymers or metal alloys.

Snare unit 74, which comprises snare wires 32 fixedly attached to mounting members 38 and 41, is thus secured to tray-like member 64, which, in turn, is securely seated upon circumferential bearing edge 16. As with the preferred embodiment of the present invention, snare wires 32 are directed to abut against bottom surface 20 to enable the characteristic snare sound upon the striking of batter head 18*a*.

Figure 9:
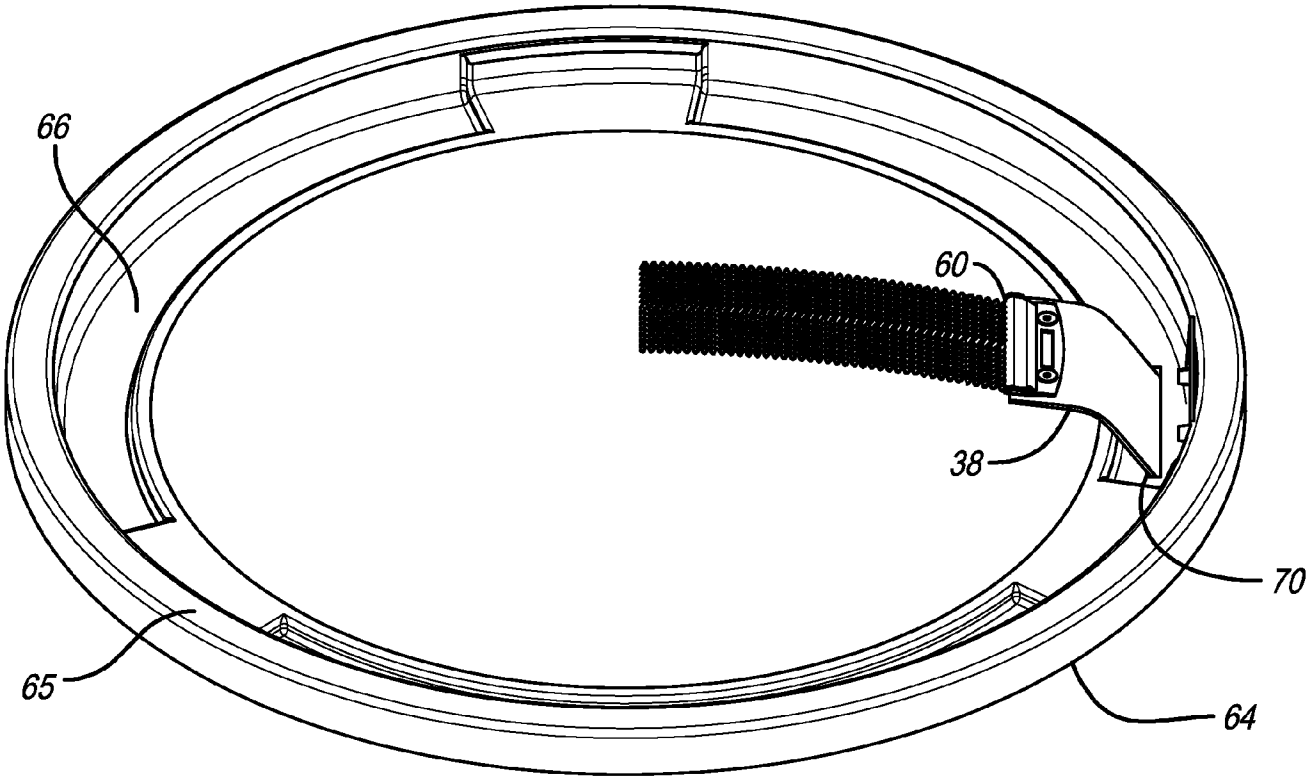
FIG. 9 is a top perspective view of the snare assembly shown in accordance with an alternative embodiment of the present invention.
Figure 9A:
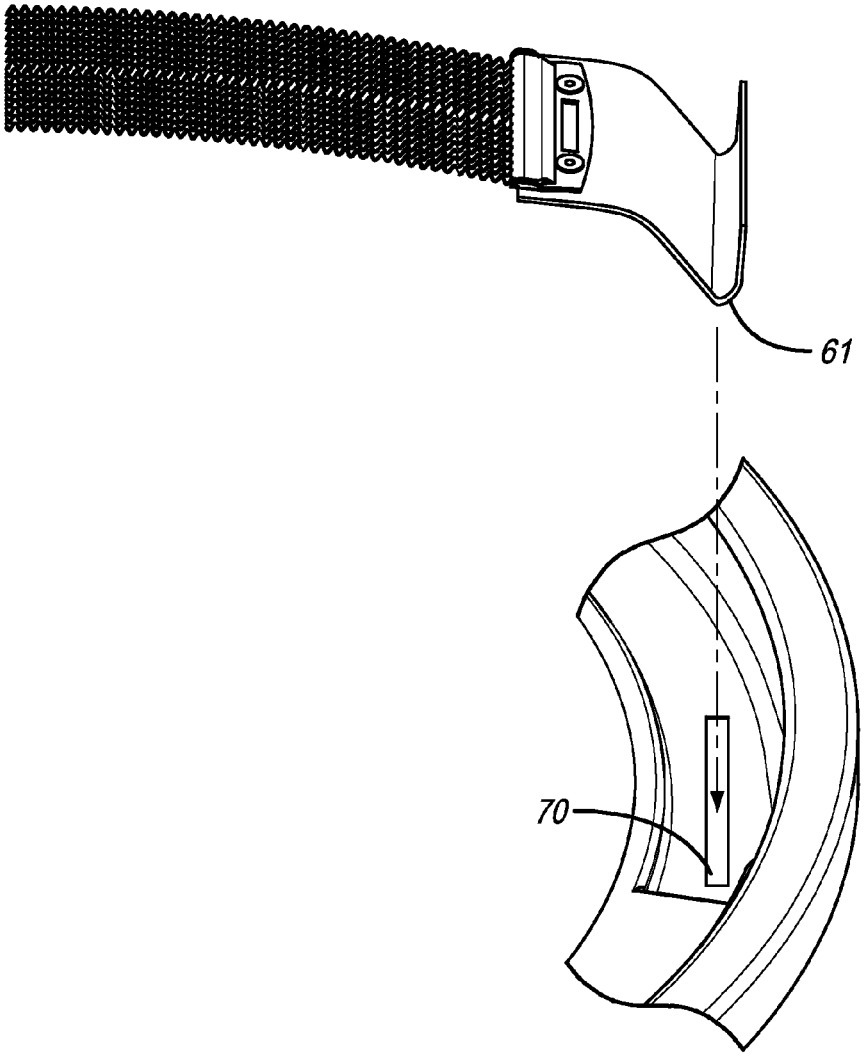
FIG. 9A is an exploded view of the snare assembly in accordance with an alternative embodiment of the present invention.
Figure 10:
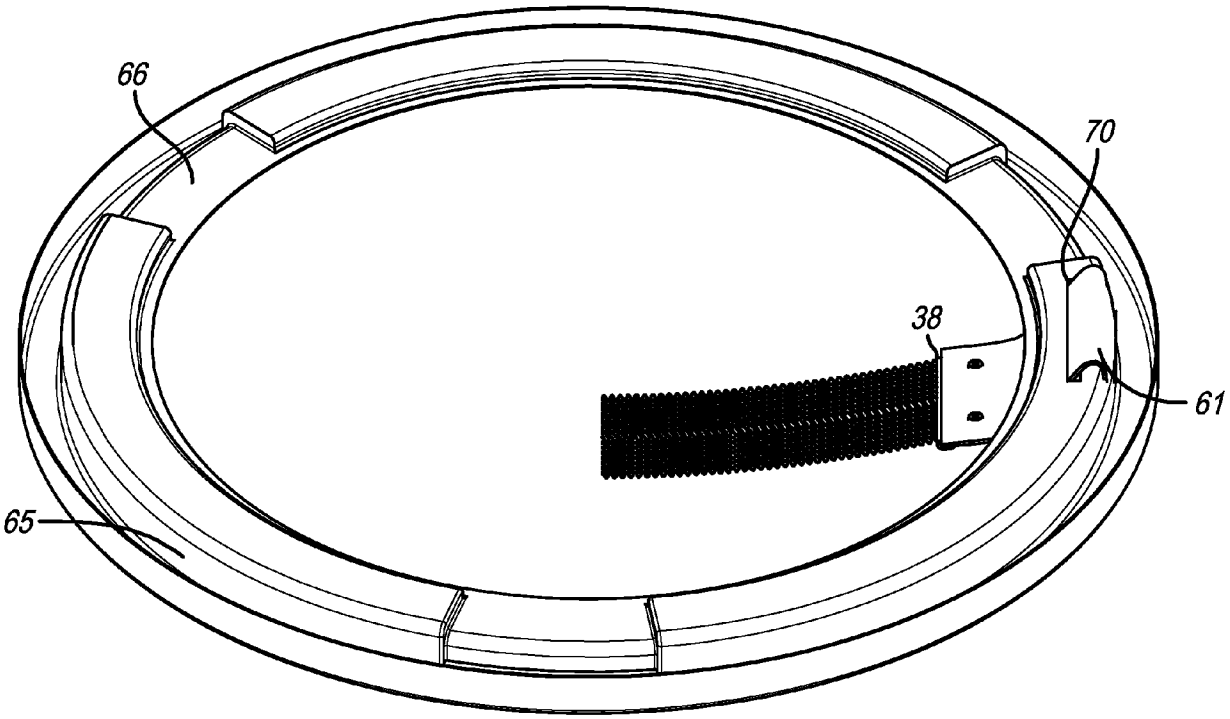
FIG. 10 is a bottom perspective view of the snare assembly shown in accordance with an alternative embodiment of the present invention.
Figure 11:
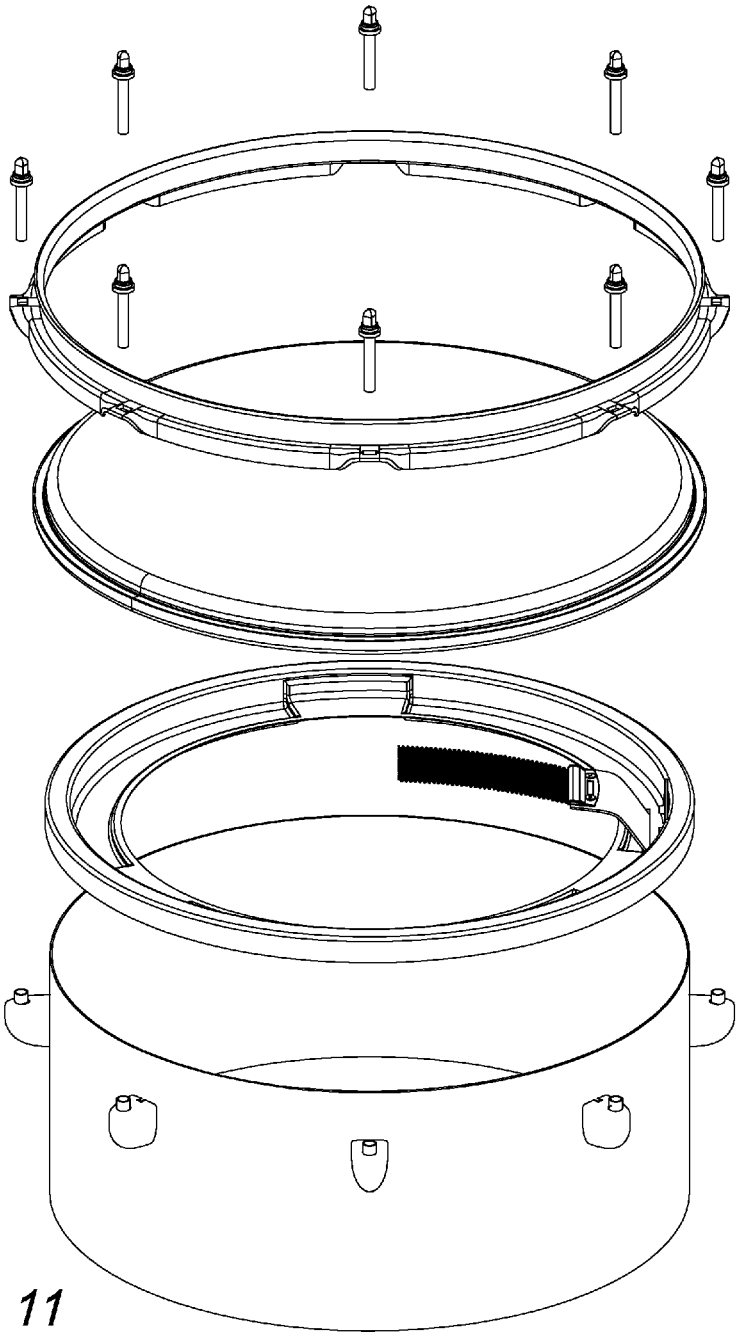
FIG. 11 is an exploded view of the snare assembly in accordance with an alternative embodiment of the present invention shown with various musical drum components and hardware.
Figure 12:
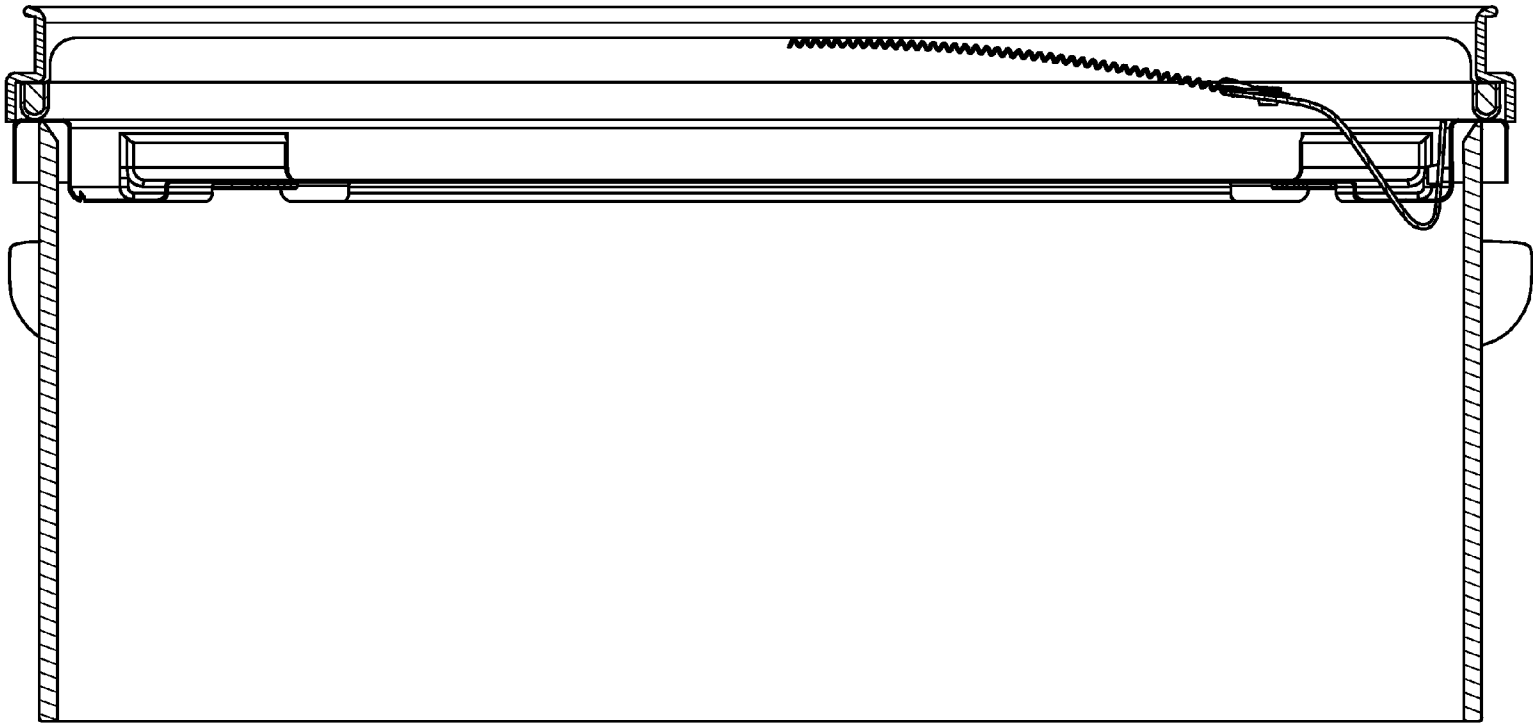
FIG. 12 is a cross-sectional view of the snare assembly in accordance with an alternative embodiment of the present invention.
Figure 13:
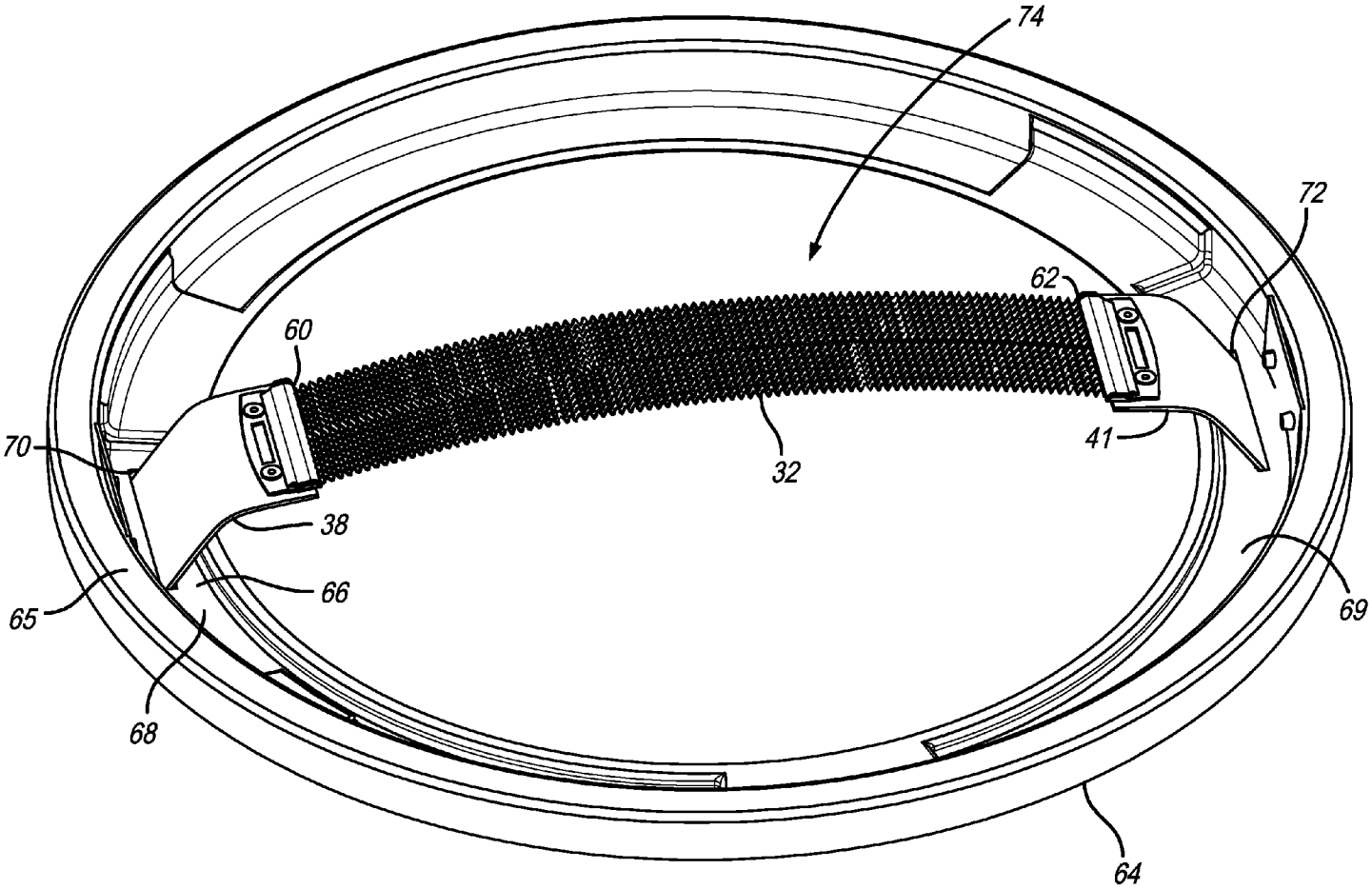
FIG. 13 is a perspective view of the snare assembly shown in accordance with an alternative embodiment of the present invention.
Figure 14:
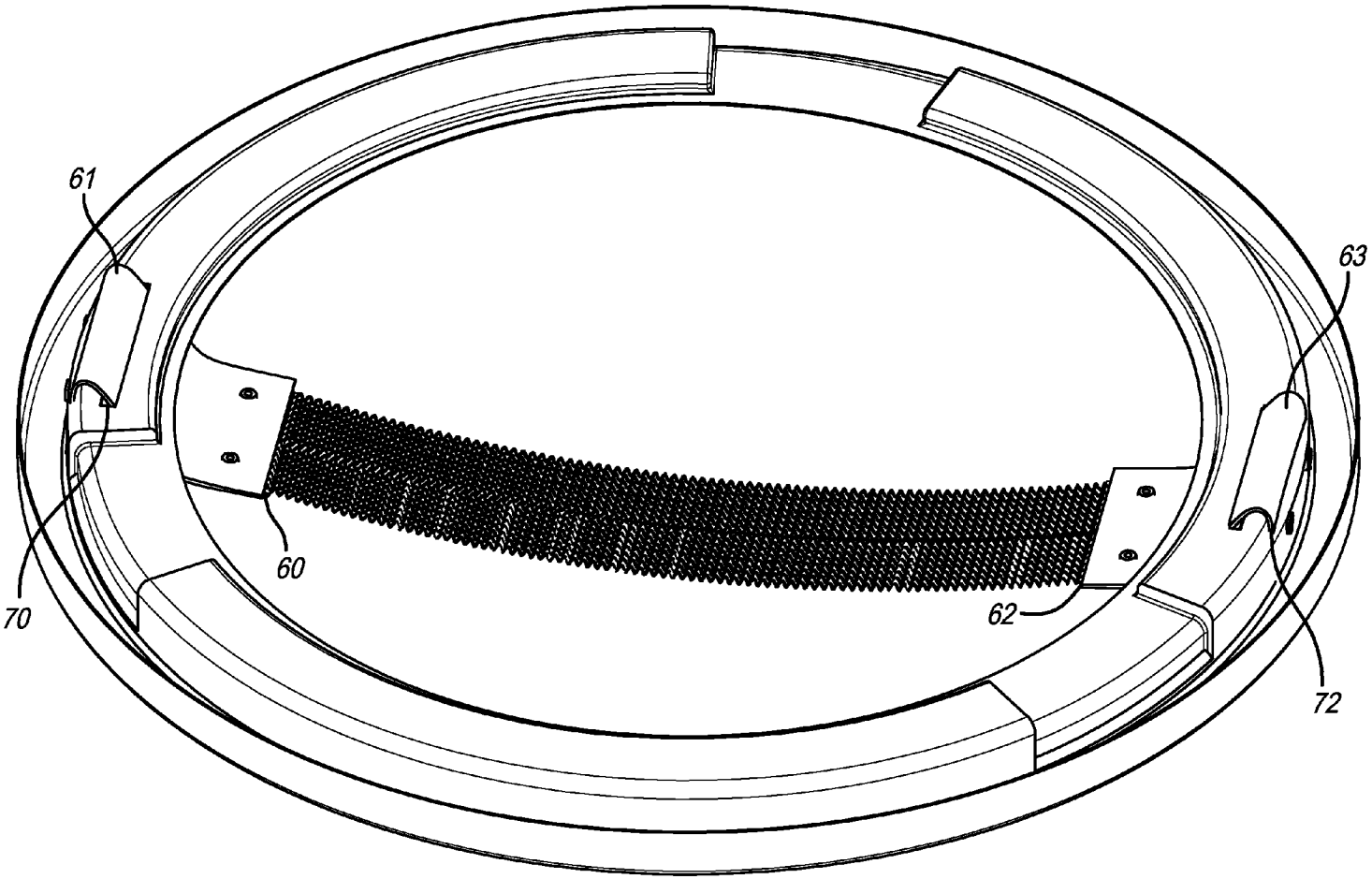
FIG. 14 is a bottom perspective view of the snare assembly shown in accordance with an alternative embodiment of the present invention.
Figure 15:
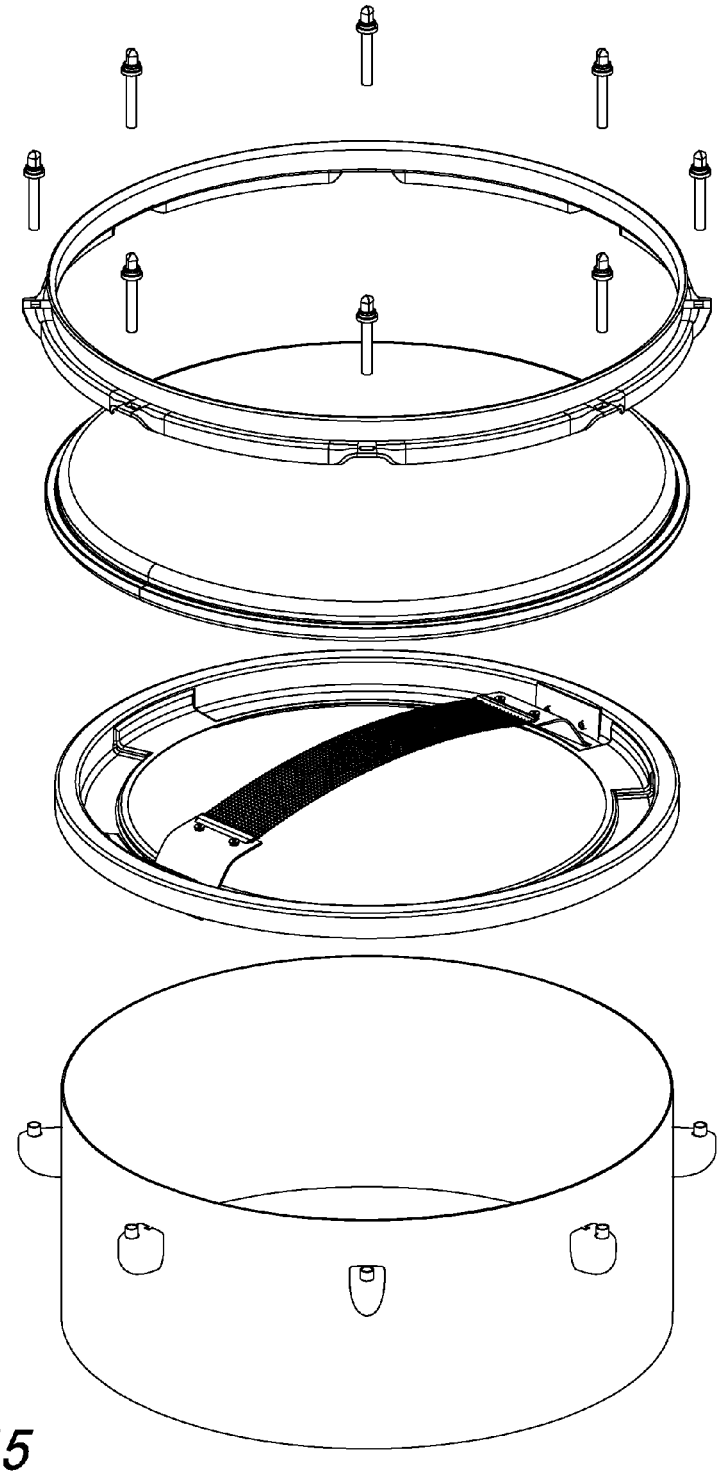
FIG. 15 is an exploded view of the snare assembly in accordance with an alternative embodiment of the present invention shown with various musical drum components and hardware.
Figure 16:
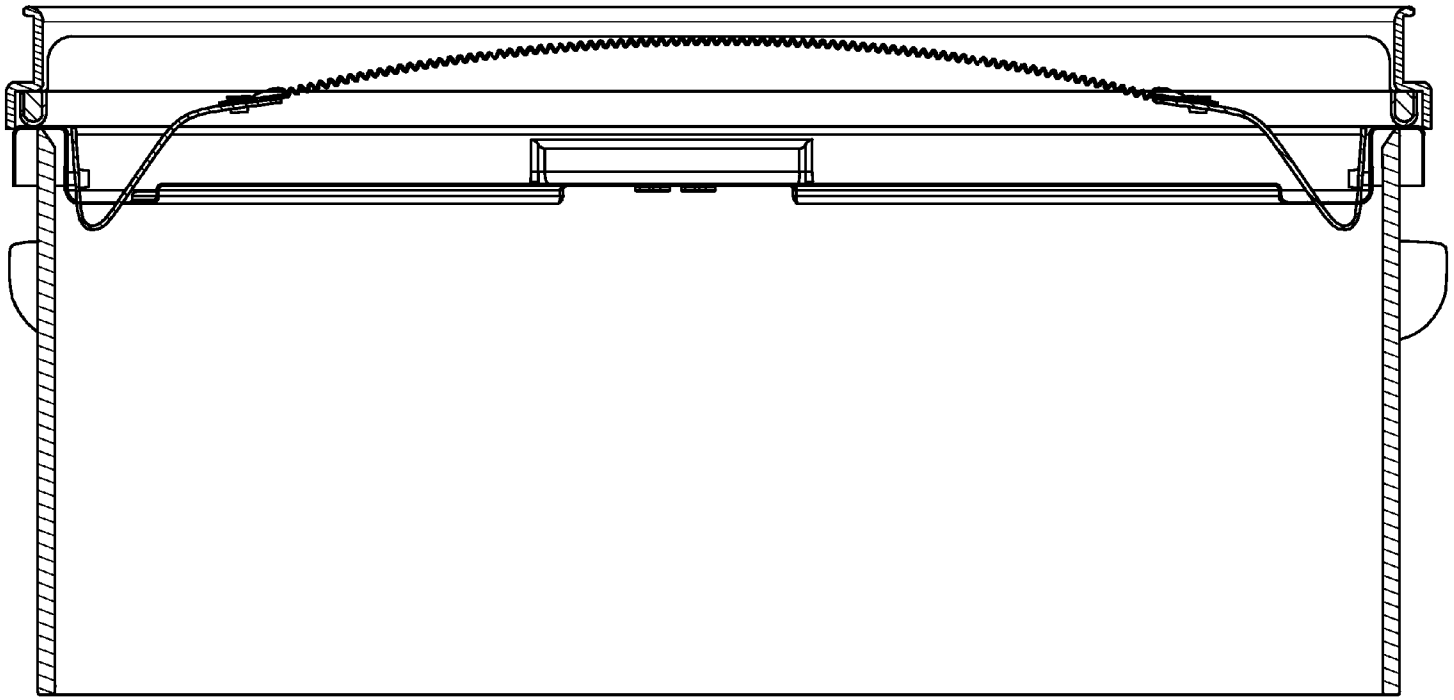
FIG. 16 is a cross-sectional view of the snare assembly in accordance with an alternative embodiment of the present invention.

Another alternative embodiment of the present invention comprises a single mounting member, such as mounting member 38, fixed to only a single end portion, such as end portion 60, as shown in FIG. 9. Mounting member 38 includes generally curved or bent retention end portion 61. Tray-like member 64 is also provided and includes channeled rim portion 65 adapted for seating engagement upon circumferential bearing edge 16 and annular support member 66 integrally formed with channeled rim portion 65. Annular support member 66 includes slotted opening 70 formed to receive curved or bent retention end portion 61 in mating relationship.

To complete the assembly of the typical musical drum 10, counterhoop 80, which fits over drumhead 17, and appropriate hardware, which includes tension rods 84 and tuning lugs 86 for tensioning drumhead 17, are provided.

Although musical drum 10 used in accordance with the present invention is typically conventional in structure and appearance, alternatives are available at considerably less cost. An example are the plastic and metal pails commonly sold at home improvement centers and neighborhood hardware stores.

While the invention will be described in connection with a certain preferred embodiment, it is understood that it is not intended to limit the invention to that embodiment. Rather, it is intended to cover all alternatives, modifications and equivalents as may be included within the spirit and scope of the invention as defined by the appended claims.

The invention claimed is:

1. A musical drum, comprising:

a hollow shell having at least one opening, said opening being defined by a circumferential bearing edge;

a drumhead covering said opening, said drumhead having an upper surface comprising a batter head and an integrally formed bottom surface disposed as the underside of said upper surface;

a snare assembly, said snare assembly having a plurality of individual wires, said individual wires having opposite end portions, a first mounting member, said first mounting member being fixed to at least one of said end portions, and means for releasable attachment to said circumferential bearing edge;

said individual wires being disposed in abutment against said bottom surface of said drumhead to cause said individual wires to vibrate upon the striking of said batter head.

2. The musical drum of claim 1 wherein said means for releasable attachment to said circumferential bearing edge comprises a flexible U-shaped clip adapted for engagement with said circumferential bearing edge in pressure-contact relation.

3. The musical drum of claim 1 wherein said first mounting member is resiliently bent at an outwardly facing reflex angle.

4. The musical drum of claim 1 wherein said first mounting member and said means for releasable attachment to said circumferential bearing edge are integrally formed.

5. The musical drum of claim 1 wherein said individual wires are attached to said first mounting member by screws or rivets.

6. The musical drum of claim 1 wherein said individual wires are welded to said first mounting member.

7. The musical drum of claim 1 wherein said individual wires are comprised of metal alloy.

8. The musical drum of claim 1 wherein said individual wires are comprised of synthetic polymer material.

9. The musical drum of claim 1 wherein said individual wires are spread fan-like.

10. A musical drum, comprising:

a hollow shell having at least one opening, said opening being defined by a circumferential bearing edge;

a drumhead covering said opening, said drumhead having an upper surface comprising a batter head and an integrally formed bottom surface disposed as the underside of said upper surface;

a snare assembly, said snare assembly having a plurality of individual wires, said individual wires having opposite first and second end portions, a first mounting member and a second mounting member, said first mounting member being fixed to said first end portion and said second mounting member being fixed to said second end portion, and means for releasable attachment to said circumferential bearing edge;

said individual wires being disposed in abutment against said bottom surface of said drumhead to cause said individual wires to vibrate upon the striking of said batter head.

11. The musical drum of claim 10 wherein means for releasable attachment to said circumferential bearing edge comprises a first flexible U-shaped clip integrally formed with said first mounting member and adapted for engagement with said circumferential bearing edge in pressure-contact relation and a second flexible U-shaped clip integrally formed with said second mounting member and adapted for engagement with said circumferential bearing edge in pressure-contact relation.

12. The musical drum of claim 1 comprising a second mounting member, said second mounting member being fixed to said other end portion, said first mounting member and said second mounting member each having a curved end retention portion, wherein said means for releasable attachment to said circumferential bearing edge includes a tray-like member with a channeled rim portion for seating engagement upon said circumferential bearing edge and an annular support member integrally formed with said channeled rim portion, said annular support member having opposing surfaces and means formed within said opposing surfaces for fixedly securing said first mounting member and said second mounting member.

13. The musical drum of claim 12 wherein said means formed within said opposing surfaces for fixedly securing said first mounting member and said second mounting member comprises spaced opposed slotted openings conformed to matingly receive corresponding said curved retention end portions of said first mounting member and said second mounting member.

14. The musical drum of claim 1 wherein said means for releasable attachment to said circumferential bearing edge includes a tray-like member with a channeled rim portion for seating engagement upon said circumferential bearing edge and an annular support member integrally formed with said channeled rim portion, said annular support member having means for fixedly securing said first mounting member in mating relationship.

15. The musical drum of claim 14 wherein said means for fixedly securing said first mounting member comprises a slotted opening formed within said annular support member and conformed to matingly receive said first mounting member.

16. The musical drum of claim 2 wherein said flexible U-shaped clip is comprised of a metal alloy or a synthetic polymer material.

17. The musical drum of claim 12 wherein said tray-like member is comprised of a synthetic polymer material or a metal alloy.

* * * * *